United States Patent [19]

Marchello et al.

[11] 4,007,571

[45] Feb. 15, 1977

[54] PANEL ATTACHMENT SYSTEM

[75] Inventors: Maurice J. Marchello, Hickory Hills; Gordon H. Bassett, Buffalo Grove, both of Ill.

[73] Assignee: United States Gypsum Company, Chicago, Ill.

[22] Filed: Mar. 27, 1972

[21] Appl. No.: 241,612

[52] U.S. Cl. ..... 52/483; 52/289; 52/489

[51] Int. Cl.[2] ..... E04F 13/08

[58] Field of Search ..... 52/483, 144, 145, 289, 52/377, 371, 370, 357, 359, 361, 362, 363, 509, 511, 512, 490, 489

[56] References Cited

UNITED STATES PATENTS

| | | | |
|---|---|---|---|
| 979,628 | 12/1910 | Wright et al. | 52/370 |
| 1,297,523 | 3/1919 | With | 52/363 X |
| 1,792,747 | 2/1931 | Lewis | 52/512 |
| 1,998,423 | 4/1935 | Stubbs | 52/483 X |
| 2,066,005 | 12/1936 | Jenkins | 52/489 X |
| 2,066,006 | 12/1936 | Kellogg | 52/489 X |
| 2,154,590 | 4/1939 | Vokes | 52/259 |
| 2,315,420 | 3/1943 | Harrington | 52/489 X |
| 2,367,392 | 1/1945 | Gent | 52/361 X |
| 2,667,667 | 2/1954 | Jacabon | 52/144 X |
| 2,765,466 | 10/1956 | Gaines | 227/77 |
| 3,826,055 | 7/1974 | Bobzin | 52/483 |

FOREIGN PATENTS OR APPLICATIONS

| | | | |
|---|---|---|---|
| 1,021,557 | 12/1957 | Germany | 52/489 |
| 886,377 | 8/1953 | Germany | 52/144 |

OTHER PUBLICATIONS

American Builder, May 1965, pp. 1 and 135, "Wall paneling planks are T & G'd."

*Primary Examiner*—Leslie Braun
*Attorney, Agent, or Firm*—Donnie Rudd; Samuel Kurlandsky; Robert H. Robinson

[57] ABSTRACT

A framing assembly which braces the back of the panel with metal strips attached to the sides of adjacent framing members after they are attached to the panel, to permit secure bracing regardless of warping present in the framing members.

2 Claims, 6 Drawing Figures

PANEL ATTACHMENT SYSTEM

BACKGROUND OF THE INVENTION

In manufactured housing, it is necessary that the wall and ceiling components be assembled quickly, by a construction which will have the appearance of custom building. Particularly in the mobile home industry, the approach to the assembly of ceiling panels has been to attach them to rafters from below by means of staples, screws, nails, or other mechanical attaching means penetrating the panel from the decorative side, and thereafter to cover the attaching means with decorative means made as attractive as possible. Some examples of such means include rosettes, paint, and batten strips inserted into the panel over recessed portions attached by the staples or other attaching means. U.S. Pat. No. 3,545,154 is an example of the latter construction. Such construction can either feature staples driven by a stapler with their ends maintained parallel, as in U.S. Pat. No. 2,765,465, or so as to diverge outwardly around an anvil portion of the stapler, as in U.S. Pat. No. 2,765,466. In any event because most systems have required the attachment be made from the decorative side, they have been characterized by a lack of a uniformly smooth, unbroken surface characteristic of a custom-built home. Even joint treatment and paint as the decorative cover do not always prevent "nail-popping" resulting from shrinkage in the wood framing.

Thus, there has been considerable need for a means of mechanical attachment of panels to form a wall or ceiling which is done from a point that will not show or cause a break in the plane of the decorative surface of the panels. At least, breaks must be minimized. Mechanical fasteners, as opposed to chemical adhesives, have been particularly required in ceiling construction, due to the large size panels involved (4 feet by 12 feet), and by the fact that, in many cases, vapor barriers are required which prevent the use of adhesive.

Floor and ceiling constructions have been provided wherein divergent members such as staples have penetrated from and into the back surface only of ceiling board, but such constructions have suffered disadvantages. One such construction has featured metal members attached to the underside of the rafters and extending the full width of the panel, staples being driven in a straddling fashion over the metal members and into the back of the panel so as to diverge the staple points. The difficulty with this construction has been that the warping which is so characteristic of rafters has prevented the metal members which are first attached thereto from being securely attached to the flat, planar ceiling panel.

Still another construction has featured clips which do not extend a substantial distance across the panel, but rather are attached at only one end thereof to only one rafter. Such clips provide inadequate reinforcement so that rigidity between rafters comes from the board alone.

SUMMARY OF THE INVENTION

The invention concerns a framed assembly wherein the panels are mechanically attached to framing members from the back surface only thereof, in a manner which insures adequate cross-bracing of the panels regardless of warping present in the framing members. More particularly, there is provided a novel, improved framed assembly and method of framing, the assembly comprising framing members, a gypsum panel having a decorative surface and a back surface, metal strips attached to and extending generally perpendicular to the members and bridging the space between the same, means penetrating to only the back surface of the panels for holding the back surface adjacent to the metal strips; the improvement comprising the strips extending only between two adjacent ones of said members, the ends of the strips being bent so as to extend generally along non-panel-contacting surfaces of the two members, said strips being held in intimate contact with said back surface regardless of any warping of the framing members. The method is characterized by the steps of positioning the framing members and strips across the back surface, and fastening the strips to the back surface and the framing members by the holding means, the fastening step being characterized by attaching the strips first to the panel, and then to the framing members.

Accordingly, it is an object of the invention to provide a lightweight framed assembly and method of construction suitable for manufactured housing, wherein adequate bracing of the panel is provided even when the main framing members provide a skewed, non-planar attachment surface.

A related object of the invention is to provide such an assembly and method wherein a minimum of parts are required which brace the back of the panel in between main framing members.

Still another object of the invention is to form a ceiling structure from such an assembly and such a method.

Other objects and advantages will become apparent upon reference to the following drawings and detailed discussion.

DESCRIPTION OF THE PREFERRED EMBODIMENT

The disclosure relates to a framing assembly and method of construction which are particularly suitable to manufactured housing. More specifically, mechanical attaching means are provided wherein only the back surface of the panel is affected, thereby leaving an unbroken decorative or front panel surface, characteristic of custom-built houses, the attachment being done in a manner which insures that the metal strips or cross-members lie flat against the panel regardless of any warping present in the framing members.

Although for purposes of discussion, the illustrated embodiments are ceiling panels, the invention is not at all limited to that particular type of framing assembly, as it can also apply to a wall.

Where terms such as "upper" and "lower" are used in this application, reference is made to orientations which exist in the final assembly.

Figure 1:
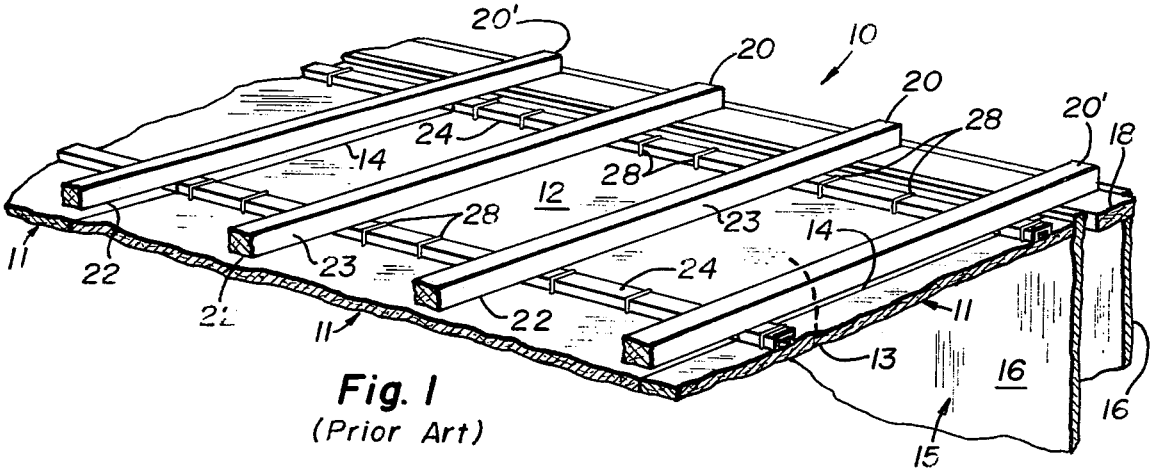
Fig. 1 (Prior Art)
FIG. 1 is a fragmentary, partially sectioned perspective view of a ceiling constructed in accordance with one prior art technique.

Turning to FIG. 1, there is illustrated a composite ceiling structure 10 comprising individual panels 11 each having a back surface 12, a front decorative surface 13, and outer edges 14. The ceiling is a prior art construction which extends from a wall 5 conventionally constructed from wallboard panels 16, and a top plate 18. The outer one of the panels 16 may comprise, for example, sheathing which is to be covered by exterior surfaces such as shingles. The ceiling is conventionally supported from above by rafters or framing members 20, which can be wood or metal, and which have a lower operative surface 22 and side surfaces 23.

One characteristic feature of this construction is that the rafters are braced by means which are fastened to the back surface of the panels 11, but only after the means are first attached to the rafters. This is accomplished, as shown in FIG. 1, by elongate channel-shaped anvil strips or supports 24 which extend the full width of the panel and are attached to the lower surface of the rafters by means such as screws. To hold the strips 24 in place, staples 28, shown exaggerated in size, are theoretically at least driven into the back surface 12 only of the panel, straddling the strips 24. The ends of the staple are caused to diverge by the divergent shape of the strips 24 as they penetrate the back surface.

The difficulty with such a construction has been that, invariably, the framing members or rafters 22 are warped, particularly in the vertical direction, so that their under or lower surfaces do not fall in a single plane. The preattachment of the strips 24 to such non-planar reference surfaces can only result in the strips 24 themselves being skewed with respect to each other. Frequently, such skewing renders impossible any attempt to force the strips to lie flat against the flat back surface 12 of the panels, even when the applicator attempts to force such an orientation during stapling. Unless the strips do lie flat, the staples cannot hold.

Figure 2:
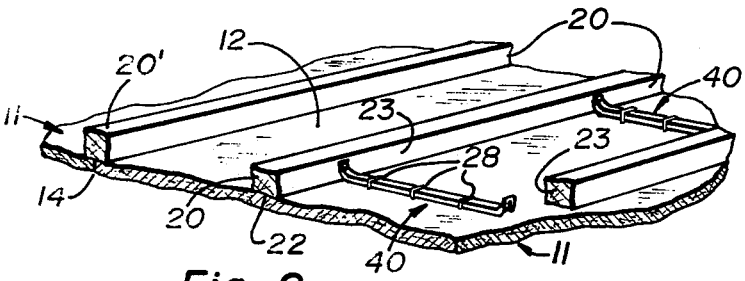
FIG. 2 is a fragmentary perspective view, partially broken away and similar to FIG. 1, but illustrating a ceiling constructed in accordance with the invention.
Figure 3:
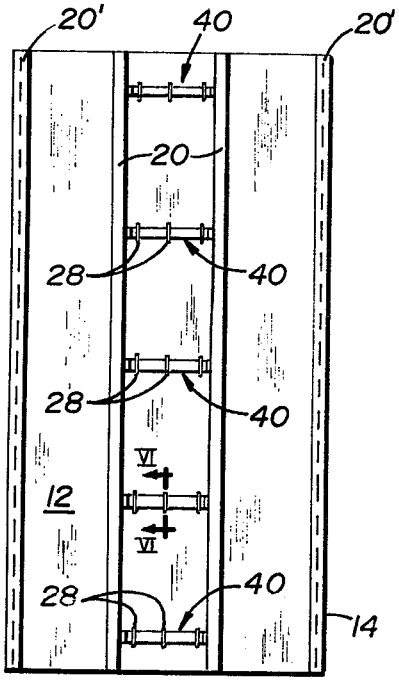
FIG. 3 is a plan view of the ceiling shown in FIG. 2, one panel only being illustrated.
Figure 4:
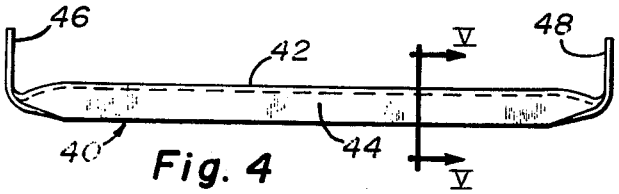
FIG. 4 is an elevational view of one of the strips shown in FIG. 3.
Figure 5:
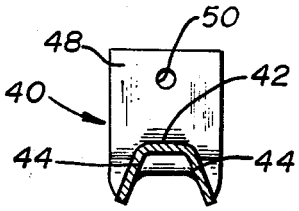
FIG. 5 is a sectional view taken generally along the line V—V of FIG. 4.

Turning now to FIGS. 2 and 3, in accordance with one aspect of the invention, there is provided an improved ceiling assembly wherein the bracing strips and the method of attachment have been modified to take into account the warping of the rafters described above. Otherwise, the same components as described above are utilized. More specifically, only the center two rafters have attached thereto metal cross-bracing strips or supports 40, and then only at the non-panel contacting side surfaces 23 thereof. The strips 40 are intimately in contact with the back surface 12 of the ceiling panel, being held there by divergent staples 28 which straddle strips 40. The strips 40 bridge the space between the center two rafters, the edge rafters 20' being secured directly to the panels from the decorative front surface of the panels 11. As shown in FIGS. 4 and 5, the strips 40 are provided with a top surface 42, and diverging, dependent side flanges 44, these flanges extending substantially from end 46 to end 48 of the strip. Each end is characterized by an upward, generally flat flange, which may be provided with means such as holes 50 for the attachment of the ends to the rafters.

Figure 6:
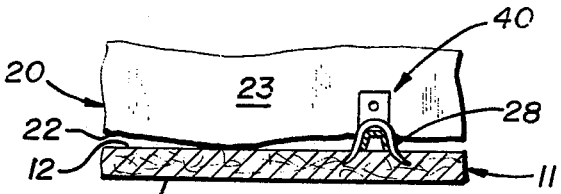
FIG. 6 is a fragmentary elevational view in section taken generally along the line VI—VI of FIG. 3.

To insure that the strips 40 lie flat against the back surface 12 even though the rafters may be warped, as shown considerably exaggerated in FIG. 6, the method of attachment is as follows: the rafters 20 and the strips 40 are positioned on the back surface in a crisscross arrangement with the strips bridging the spaces between the center rafters 20 and not sandwiched between the panel and the rafters. Preferably, the strips extend generally perpendicular to the rafters. Next, the staples 28 are driven or projected over the strips and into the back surface 12 of the panel by conventional staplers. This insures intimate contact between the strips 40 and the panel. Next, the ends 46 and 48 are attached to the opposed facing surfaces 23 of the rafters by staples, nails, or other fasteners. Finally, the composite ceiling structure is formed as in the prior art structure, by means of the rafters 20' located along the panel edges. That is, these rafters' outside edges extend outwardly beyond the longitudinal edge 14 of the panel (FIG. 2), so that such rafters can be attached directly, as by staples, to both adjacent panels or assemblies. Preferably all such assemblies are of identical construction incorporating the invention. Thus, only at the outside edges will breaks in the decorative surface appear, the stapled edges being covered with battens.

With the system described above, a 5/16 inch or a ⅜ inch panel, having its other dimensions as 4 feet and 12 feet, can be mounted on conventional rafters spaced sixteen inches O.C. by strips 40 formed from about 22 gauge metal.

Although the invention has been disclosed in conjunction with a preferred embodiment, it is not intended that it be limited thereto. For example, the strips 40 need not be confined to a placement between the center two rafters 20 only (FIG. 3), but can be occasionally moved therefrom to occupy an edge position. The important factor in all cases is to confine the attachment of the strips only to the non-panel-contacting surfaces of two adjacent strips. Thus, it is intended that the invention cover all embodiments, alternate arrangements, and equivalents as may be included within the scope of the following claims.

What is claimed is:

1. In an assembly including a panel, a plurality of spaced apart, generally coplanar framing members for supporting said panel and a plurality of elongate supports attached to one surface of said panel and extending between adjoining framing members; the improvement wherein the opposite ends of each said support are attached to two adjacent framing members at opposed, facing surfaces of said adjacent members, said supports not being directly connected one to the other, and said supports intimately contact said panel surface substantially the length of the supports, and wherein said assembly is a ceiling assembly, said panel is a ceiling board having opposed edges, and said members are rafters, one of the edges of the panel being attached to a rafter the edge of which extends beyond said edge of the panel said assembly further including fasteners straddling each of said supports and penetrating into, but not through, said panel, and wherein said fasteners are staples characterized as having a divergent extension of their ends, and wherein the supports are characterized by an anvil shape the sides of which diverge; whereby the supports cause the staples to take divergent shape as they are driven into the panel back surface over the supports.

2. In an assembly including a panel, a plurality of spaced apart, generally coplanar framing members for supporting said panel and a plurality of elongate supports attached to one surface of said panel and extending between adjoining framing members; the improvement wherein the opposite ends of each said support are attached to two adjacent framing members at opposed, facing surfaces of said adjacent members, said supports not being directly connected one to the other, and said supports intimately contact said panel surface substantially the length of the supports wherein at least one edge rafter is attached to an adjacent ceiling assembly of substantially identical construction, whereby a composite ceiling structure is formed said assembly further including fasteners straddling each of said supports and penetrating into, but not through, said panel, and wherein said fasteners are staples characterized as having a divergent extension of their ends, and wherein the supports are characterized by an anvil shape the sides of which diverge; whereby the supports cause the staples to take diverge shape as they are driven into the panel back surface over the supports.

* * * * *